US007814616B2

(12) United States Patent
Garrett

(10) Patent No.: US 7,814,616 B2
(45) Date of Patent: Oct. 19, 2010

(54) PRESSURE HINGE DEVICE FOR GLASS DOOR OR PANEL

(75) Inventor: Rodney G. Garrett, Fort Madison, IA (US)

(73) Assignee: Custom Hardware Mfg. Inc., Keokuk, IA (US)

( * ) Notice: Subject to any disclaimer, the term of this patent is extended or adjusted under 35 U.S.C. 154(b) by 0 days.

(21) Appl. No.: 11/200,967

(22) Filed: Aug. 10, 2005

(65) Prior Publication Data

US 2006/0032018 A1 Feb. 16, 2006

Related U.S. Application Data

(60) Provisional application No. 60/600,711, filed on Aug. 10, 2004.

(51) Int. Cl.
*E05D 5/02* (2006.01)

(52) U.S. Cl. ..... 16/252; 16/382

(58) Field of Classification Search ..... 16/252, 16/251, 263, 264, 380, 381, 242, 382, 303
See application file for complete search history.

(56) References Cited

U.S. PATENT DOCUMENTS

| | | | | | |
|---|---|---|---|---|---|
| 4,513,474 | A * | 4/1985 | Watabe | 16/243 |
| 4,976,007 | A * | 12/1990 | Lam | 16/302 |
| 5,297,313 | A * | 3/1994 | Brin | 16/252 |
| 5,867,869 | A * | 2/1999 | Garrett et al. | 16/252 |
| 5,970,819 | A * | 10/1999 | Katoh | 74/531 |
| 6,070,294 | A * | 6/2000 | Perkins et al. | 16/252 |
| 6,199,712 | B1 * | 3/2001 | Rosset | 220/495.01 |
| 6,481,055 | B2 * | 11/2002 | Cheng | 16/252 |
| 6,519,811 | B1 * | 2/2003 | Cheng | 16/252 |
| 6,560,821 | B2 * | 5/2003 | Miller et al. | 16/252 |
| 6,704,966 | B1 * | 3/2004 | Kao | 16/252 |
| 6,766,561 | B1 * | 7/2004 | Cheng | 16/235 |
| 6,826,802 | B2 * | 12/2004 | Chang | 16/375 |
| 6,826,870 | B2 * | 12/2004 | Chiang | 49/388 |
| 6,925,685 | B2 * | 8/2005 | Chen | 16/332 |
| 7,010,832 | B2 * | 3/2006 | Chen | 16/252 |

* cited by examiner

*Primary Examiner*—William L. Miller
(74) *Attorney, Agent, or Firm*—McKee, Voorhees & Sease, P.L.C.

(57) ABSTRACT

A hinge assembly including first and second hinge portions that are pivotable relative to one another. A pivot pin has opposite ends and is rotatably mounted in one hinge portion. The pivot pin and the other hinge portion are configured to allow the ends of the pivot pin to be threadably fastened to the other hinge body.

18 Claims, 11 Drawing Sheets

PRESSURE HINGE DEVICE FOR GLASS DOOR OR PANEL

PRIORITY STATEMENT

This application claims priority to U.S. Provisional Patent Application No. 60/600,711, filed Aug. 10, 2004, herein incorporated by reference in its entirety.

BACKGROUND OF THE INVENTION

A. Field of the Invention

The present invention relates to a pressure hinge device for a glass door panel similar to that disclosed in U.S. Pat. No. 5,867,869, which is incorporated by reference herein. In particular, the present invention relates to a method of removably fixing a pivot pin into such a hinge.

B. Prior Art

Garrett U.S. Pat. No. 5,867,869 represents a pressure hinge that can be used to mount a glass panel or door in a hingeable fashion to either a wall or other panel or door. As can be seen in the U.S. Pat. No. 5,867,869 patent, its main components are first and second clamping plates 26 and 28, a tram body 74 (which rotatably journals a main hinge pin 50), and a subroller pin 76. In the embodiment shown in the U.S. Pat. No. 5,867,869 patent FIGS. 2-5, a mounting plate 22 is used to mount the hinge to a wall or stud. In FIG. 6-8, another set of clamping elements 118 and 120 allow the hinge to be mounted to a panel or glass door.

The hinge of U.S. Pat. No. 5,867,869 works well for its intended purpose. The present invention provides an alternative way of removably mounting the main pivot pin 50 into clamping element or clamp body 26.

As can be seen at FIG. 5 of U.S. Pat. No. 5,867,869, the disclosed example of mounting main pivot pin or roller 50 in clamp body 26 is as follows. Flattened ends 52 at opposite ends of main pivot roller 50 fit into slots 48 and 49 in connecting platform 34 of clamping body 26. This is after main roller pin 50 has been rotatably journaled in tram body 78 (where its flattened opposite ends 52 extend from opposite sides of tram body 78). Set screws 54 and 56 are threadable into mating bores perpendicular to one of the flattened sides 52 of each end of main roller pin 50 (see FIG. 5). By this method, tightening of the set screws 54 and 56, so that they abut a flattened end 52 at each end of main roller pin 50, are used to secure main roller pin 50 and the entire other half of the hinge (tram body 78 and mounting plate 22), into clamp body 26. An advantage of this arrangement is that if the half of the hinge body comprised of mounting plates 26 and 28 is turned generally perpendicular from its normal indexed position, set screws 54 and 56 are accessible. Also, they are easy to operate, non-complex, and relatively inexpensive. Backing the set screws off sufficiently frees up main roller pin 50 to be removed from clamping member 26. Conversely, it is relatively easy and quick to fix main roller pin 50 into clamping member 26 when installing the hinge.

However, in certain circumstances this arrangement can result in stripping of set screws and/or turning of main roller pin 50 in its position in slots 48 and 49 of clamping member 26. As can be appreciated, in certain circumstances, the set screws may not be sufficient to prevent stripping or even some turning of the ends of the roller pin in the slots. The present invention relates to an alternative way of securing main roller pin 50.

BRIEF SUMMARY OF THE INVENTION

Instead of utilizing the set screw arrangement described above with respect to fixing main roller pin 50 into clamping member 26, as shown and described in U.S. Pat. No. 5,867,869, the present invention uses screws or other fasteners to hold the opposite ends of main roller pin 50 to clamp body 26, in one aspect into slots 48 and 49.

In one aspect of the invention, the flattened ends 50 are therefore rotated 90 degrees from that shown in U.S. Pat. No. 5,867,869. This rotation presents a wider surface for an aperture through which a fastener can pass and keeps the indexing grooves 62 and 64 in the intermediate portion of the roller 50 in desired angular positions so that the through-bores are then made in both ends of roller 50. Tapped bores are made in the bottom of slots 48 and 49 that receive machine screws that pass through the openings in the ends of roller 50 and secure roller 50 in slots 48 and 49. This arrangement resists the possibility of the stripping and turning that could occur, for example, if set screws like the embodiment of U.S. Pat. No. 5,867,869 are used. It also maintains relatively easy installation and detachment of roller 50 from clamping body 26; requiring only two screws to be removed. Also, the basic operation and configuration of the overall hinge of U.S. Pat. No. 5,867,869 is retained. Complex structure and cost is not incurred.

Other aspects of the invention include a hinge assembly having a pivot pin bolted or screwed in place at opposite ends.

In another aspect of the invention a hinge assembly can include a pivot pin with opposite ends screwed or bolted in place in combination with two hinge portions that are pivotable around that pivot pin axes relative to one another, and the two portions include mounting portions for a support structure and a panel such as a door, window, divider, plate, etc. One portion of the hinge could include a clamp member that would clamp against opposite sides of portion it is supporting.

The primary aspect, advantage, feature and/or object of the present invention is to improve upon the state of the art. An additional object is to provide a securement method for a pivot pin that resists movement from its secured position but is removably securable.

Another object of the present invention is a securement structure for a pivot pin that is robust, especially for larger loads.

These and other objects, features, advantages and aspect of the invention will become more apparent with the accompanying specification and claims.

BRIEF DESCRIPTION OF THE DRAWINGS

A specific example of the invention is illustrated in the appended drawings which are summarized as follows.

DETAILED DESCRIPTION OF THE EXEMPLARY EMBODIMENT

FIGS. 1-9 illustrate an exemplary embodiment according to the present invention. This is one form the invention can take and is not the only form it can take. Variations obvious to those skilled in the art will be included within the invention.

Figure 1A:
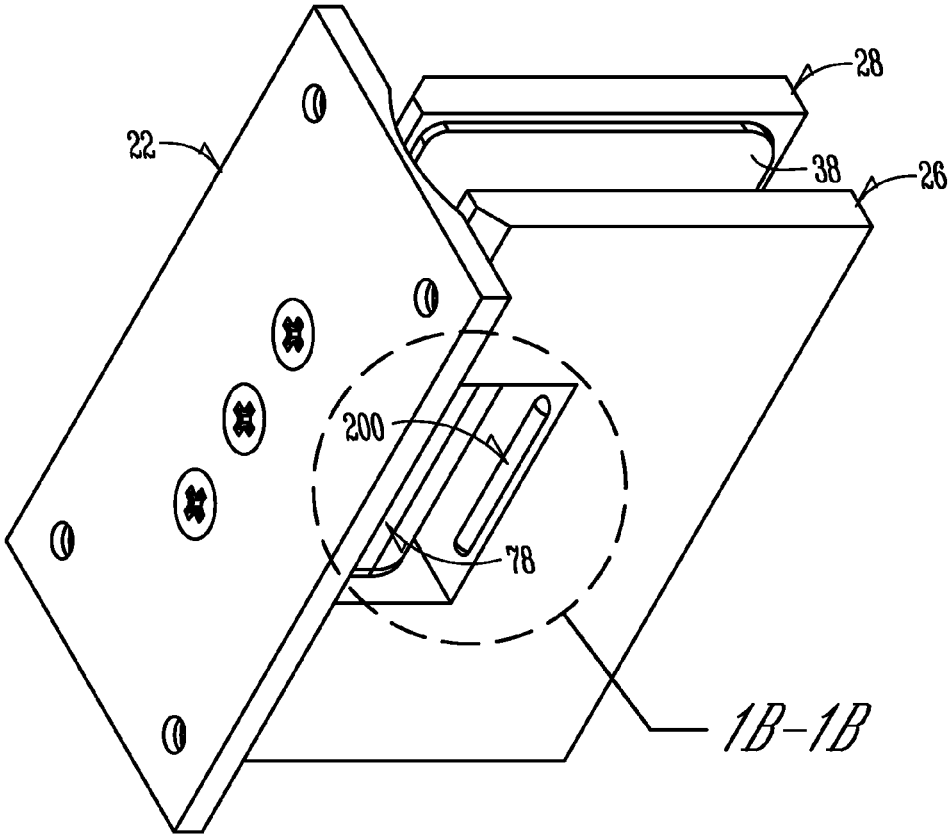
FIG. 1A is a perspective view of a hinge according to the present invention.
Figure 1B:
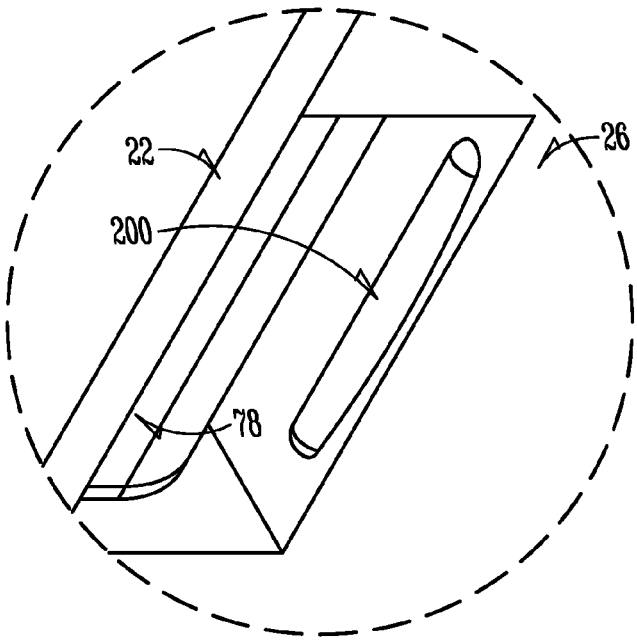
FIG. 1B is an enlarged isolated view taken at line A of FIG. 1A.
Figure 1C:
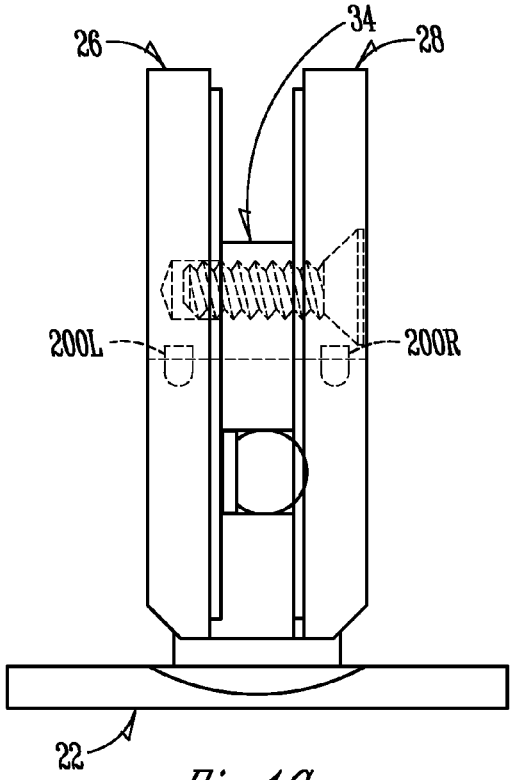
FIG. 1C is an end elevation of FIG. 1A showing, in hidden lines, interior components of the hinge.
Figure 1D:
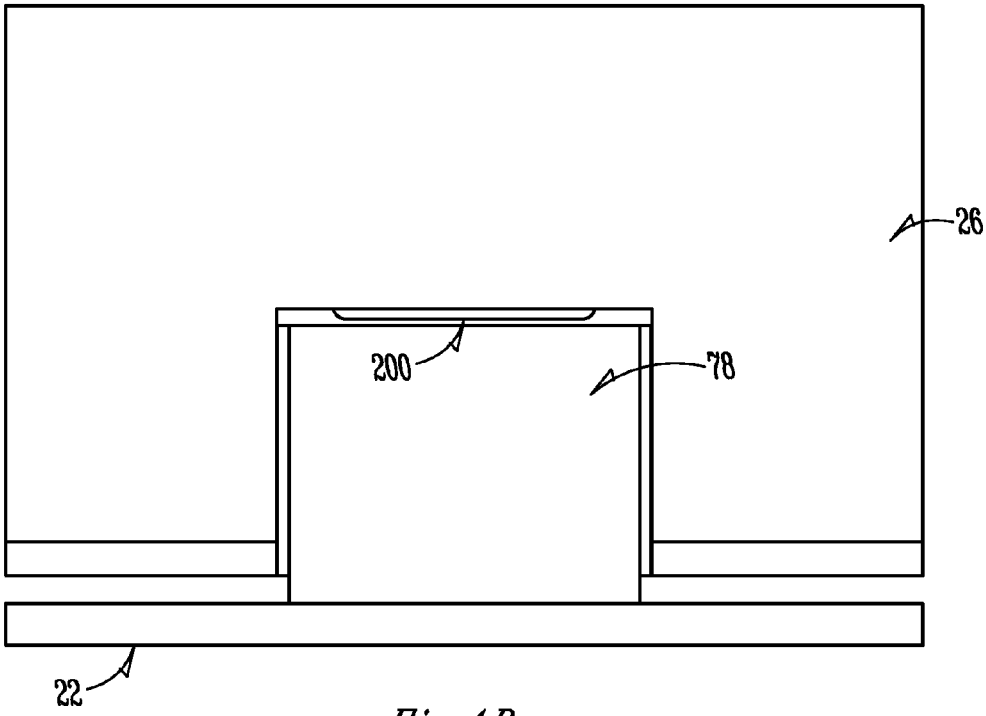
FIG. 1D is a side elevation of FIG. 1A.
Figure 1E:
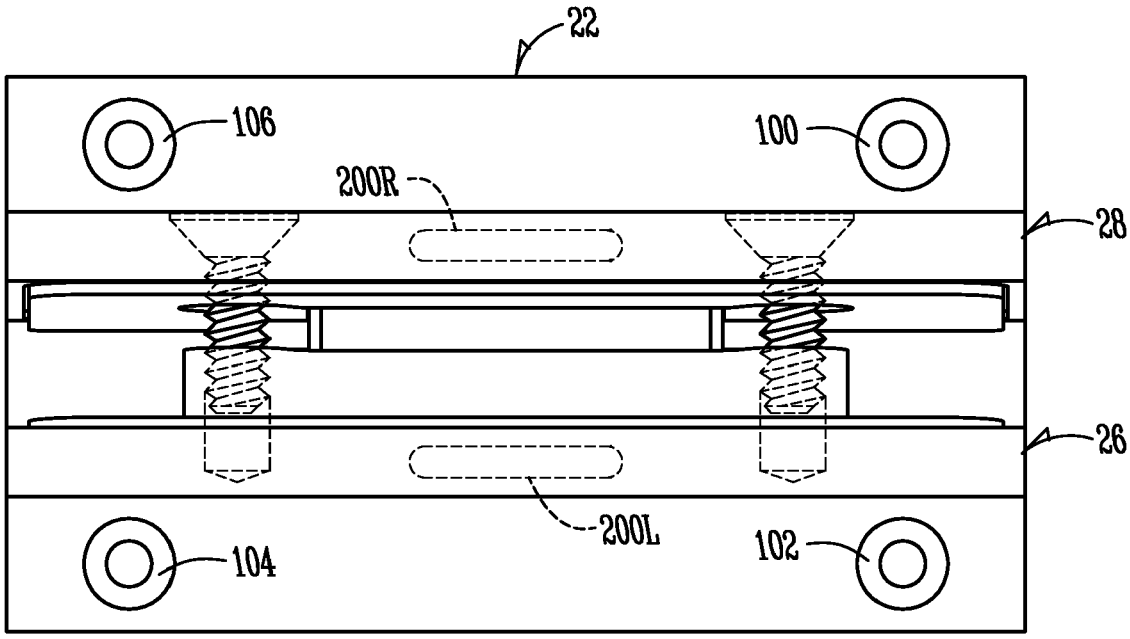
FIG. 1E is a top plan view of FIG. 1A, showing in hidden lines interior components.

In this example, the hinge has a first half which has two clamping elements 26 and 28 that are adapted to clamp on opposite sides of the glass door, the same as disclosed in U.S. Pat. No. 5,867,869. As shown in FIG. 1A, and as further indicated at FIG. 2A, each clamping body 26 and 28 can have a pocket 36 into which a conforming gasket 38 or 39 (see FIG. 5) can fit. The pocket serves to help retain the gasket and retain a good secure clamp on the glass panel or door. As noted, gasket can be elastomeric such as plastic or rubber. It is configured to nest into the formed pocket in the clamping bodies. In one aspect, it can be glued or otherwise adhered. As a result, pocket controls the position and shape of the gasket when clamping pressure is created against the panel to allow for accurate and easy installation, a crisp, aesthetically pleasing look, as the gasket is controlled so that it does not expand substantially out of the pocket.

Other aspects of the hinge of FIGS. 1-9 are relatively the same as in U.S. Pat. No. 5,867,869. A base plate 22 can be screwed to a wall or other support and can include the tram body 78 to essentially form the second part of the hinge.

The present invention pertains to main roller pin 50 that is rotatably journaled in tram body 78, and, particularly, how it is fixed to clamp body 26.

Figure 3A:
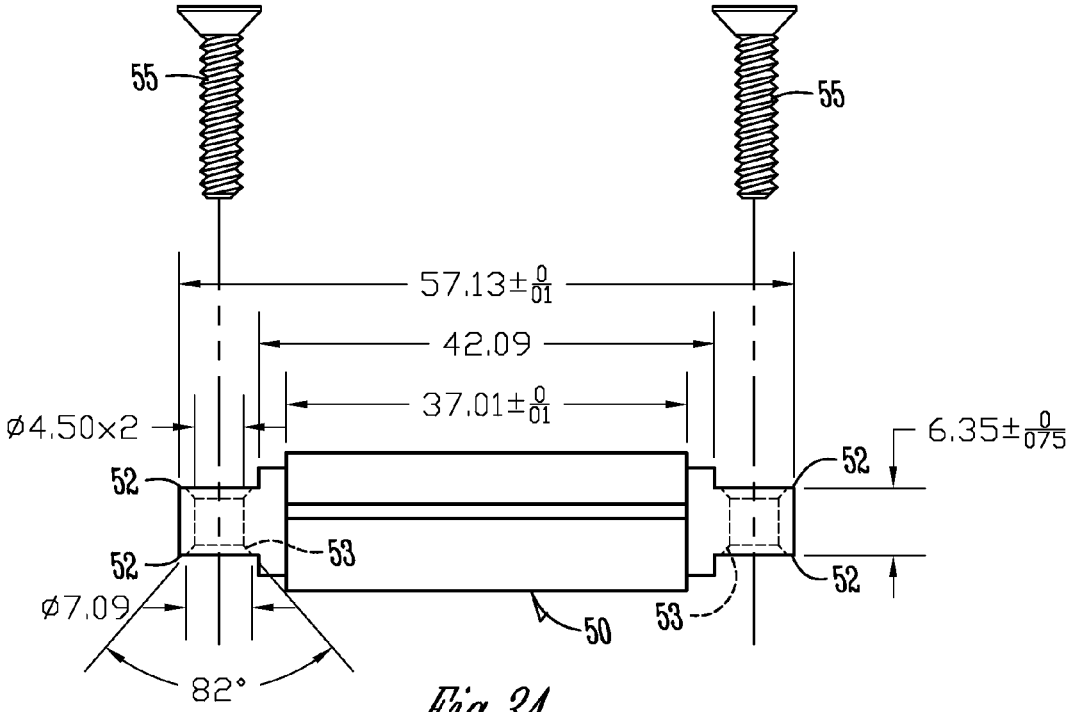
FIG. 3A is a side elevation of a main roller 50 similar to that of U.S. Pat. No. 5,867,869 as modified according to the present invention.
Figure 3B:
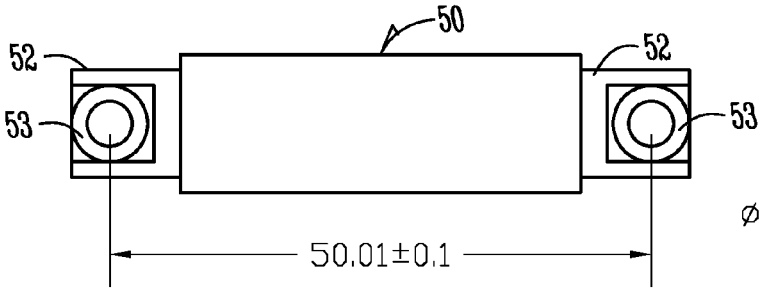
FIG. 3B is a top plan view of FIG. 3A.
Figure 3C:
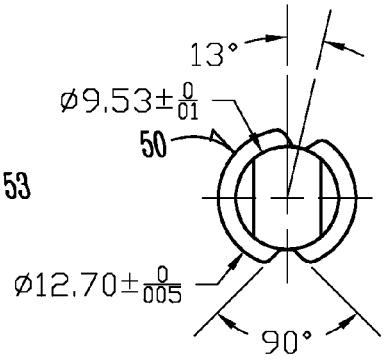
FIG. 3C is an end view of FIG. 3A.
Figure 3D:
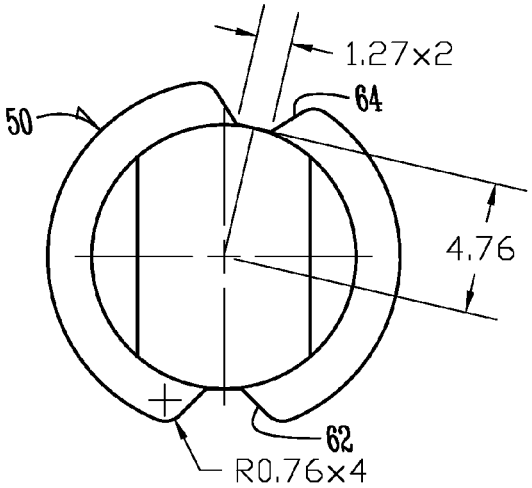
FIG. 3D is an enlarged view of FIG. 3C.
Figure 4A:
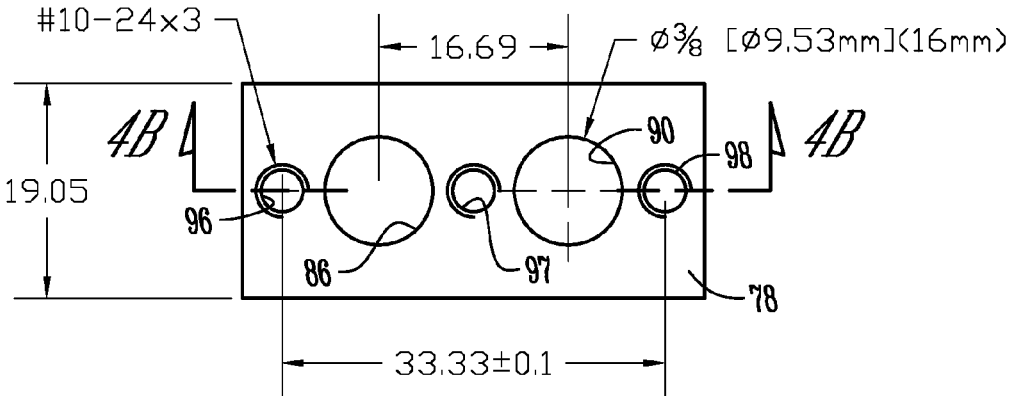
FIG. 4A is a bottom plan view of a tram body 78 similar to that of U.S. Pat. No. 5,867,869 but modified according to the present invention.
Figure 4B:
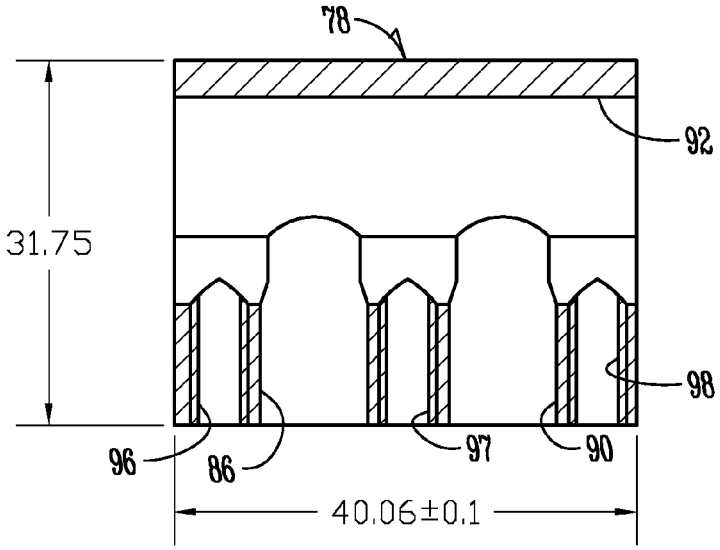
FIG. 4B is a sectional view taken along line A'-A' of FIG. 4A.
Figure 4C:
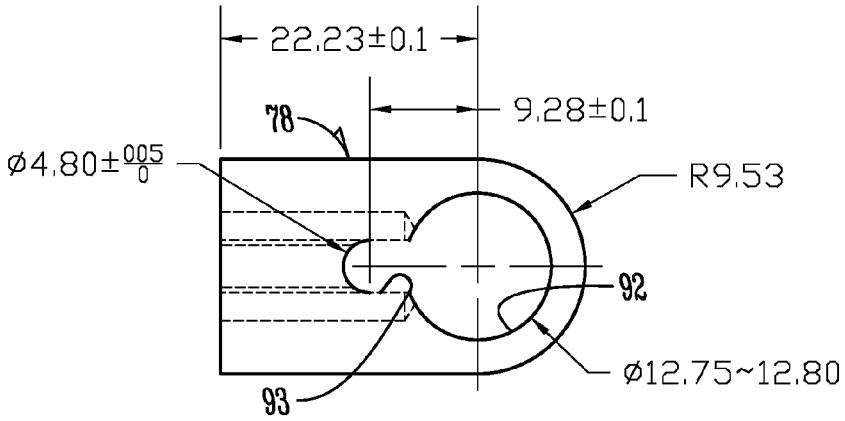
FIG. 4C is an end view of FIG. 4A.
Figure 5:
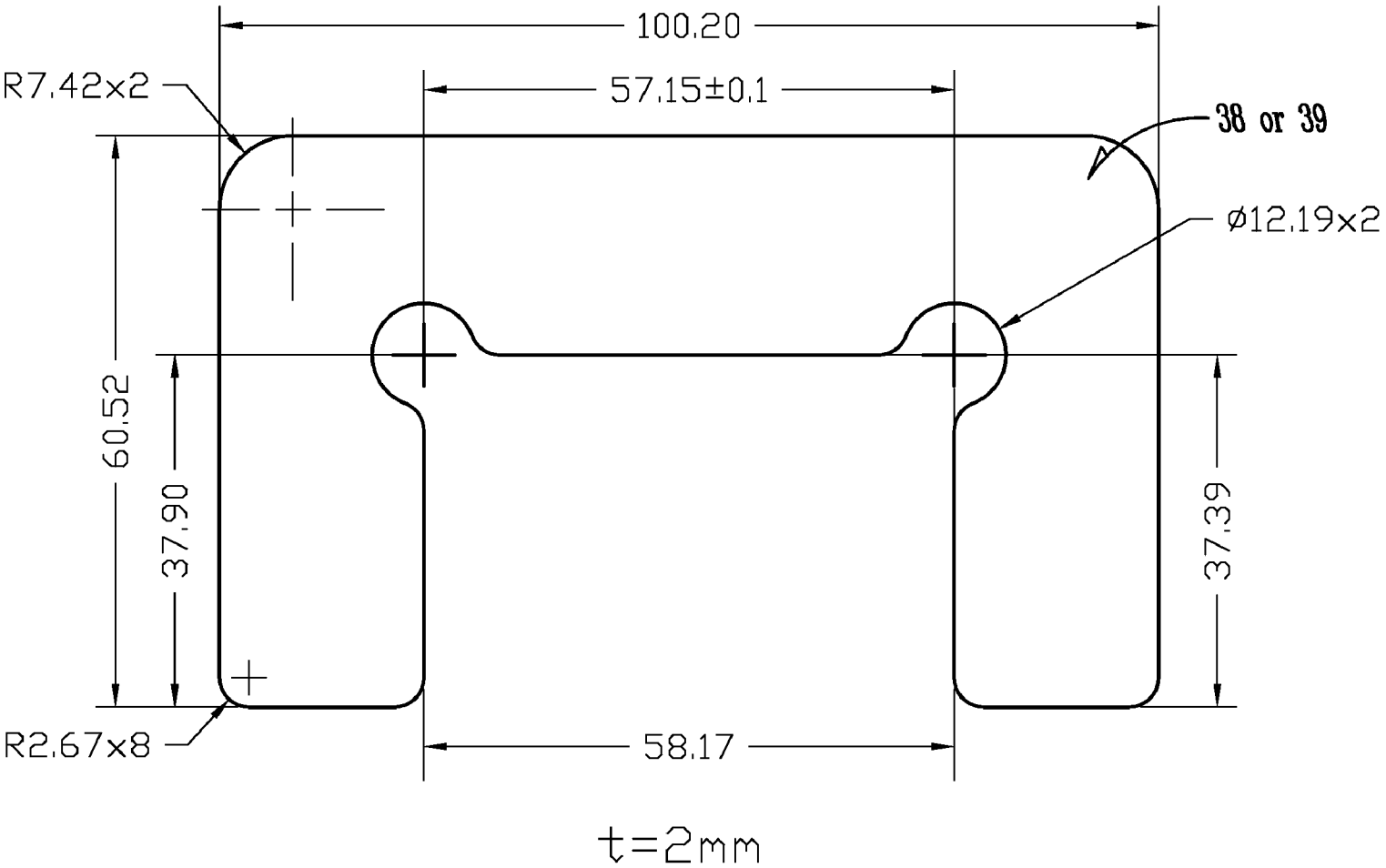
FIG. 5 is a top plan view of a gasket that can be used with the clamp body 26 of FIG. 2A.
Figure 6:
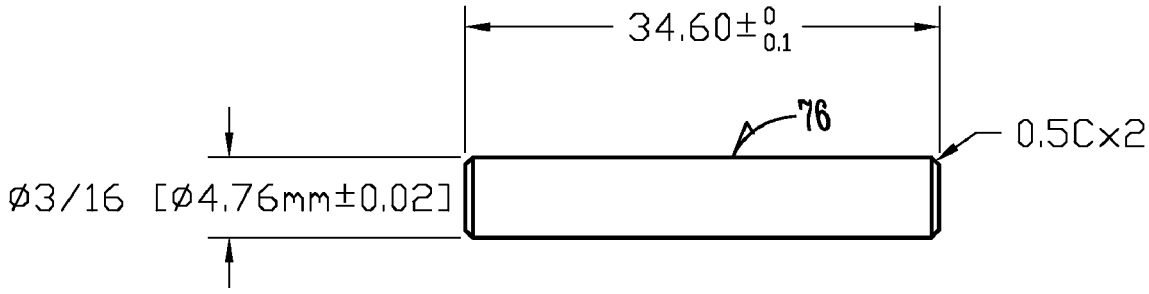
FIG. 6 is a top plan view of a subroller pin (similar to pin 76 of U.S. Pat. No. 5,867,869).
Figure 7:
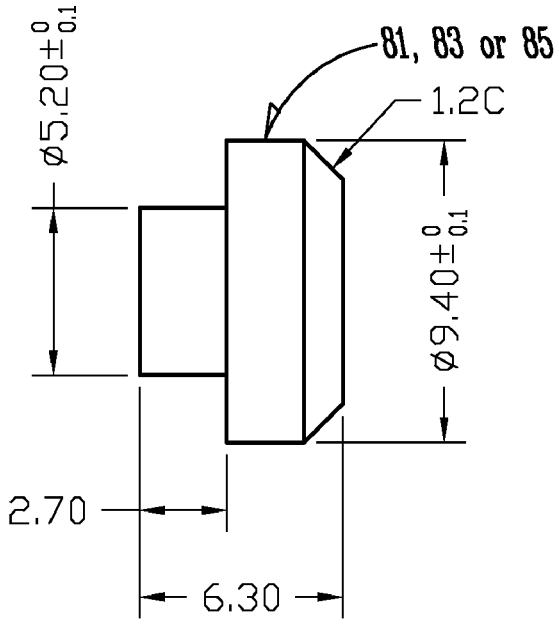
FIG. 7 is a top view of a wear pad (similar to those disclosed at reference numerals 81, 83 and 85 of U.S. Pat. No. 5,867,869) but used in the present invention.

As can be seen in FIGS. 3A and 3B, main roller 50 has opposite ends that have flattened portions 52. Unlike pin 50 of U.S. Pat. No. 5,867,869, the flattened portions 52 are rotated 90 degrees. Therefore, instead of the flattened portions 52 being adjacent to the opposite side walls of slots 48 and 49 in clamp body 26 when installed, flattened portions 52 would be parallel to the bottom of slots 48 and 49 and top of those slots when installed.

A through-bore 53 is formed between flattened surfaces 52 at each end of roller pin 50. As can be seen in FIGS. 3A and 3B, both ends of the through-bore are countersunk. In this embodiment, 8×32 Phillips flathead screws (illustrated diagrammatically at reference numeral 55 in FIG. 3A), are passed through and have their heads seated in the countersunk portion of bores 53, so that their heads are flush with the corresponding flat surface 52 but the screws cannot pass through the bore 53.

Figure 2A:
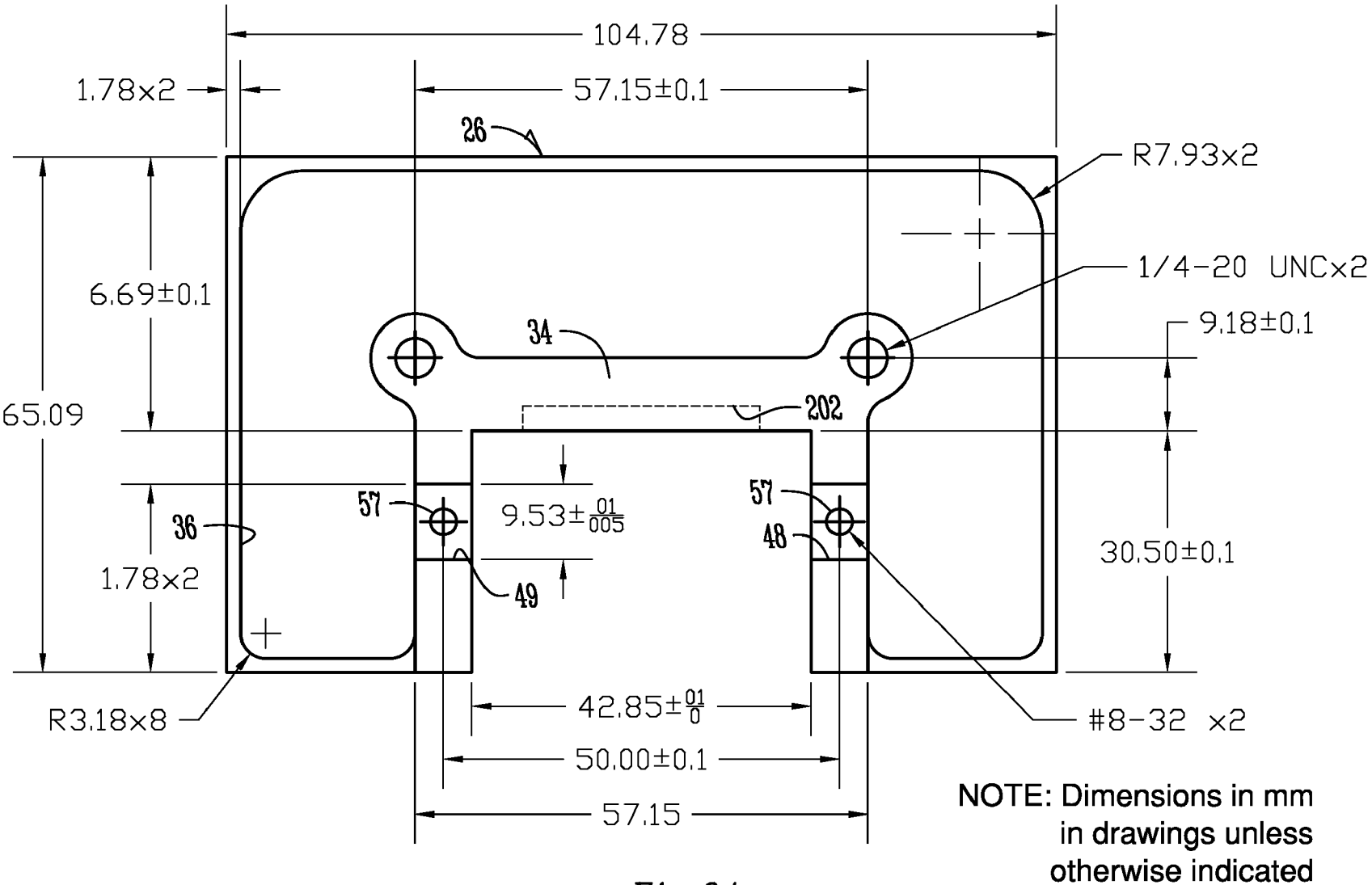
FIG. 2A is a top plan view of a clamp body 26 similar to that of U.S. Pat. No. 5,867,869, but modified according to the present invention.
Figure 2B:
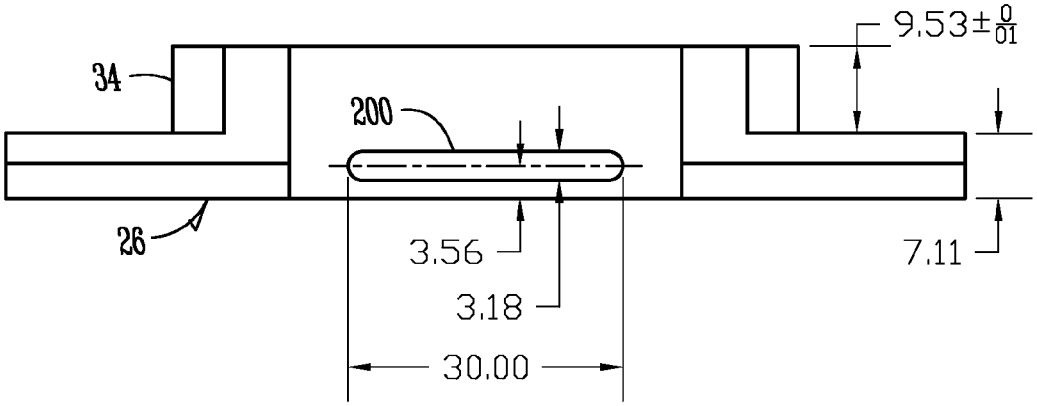
FIG. 2B is a side elevation of FIG. 2A.
Figure 2C:
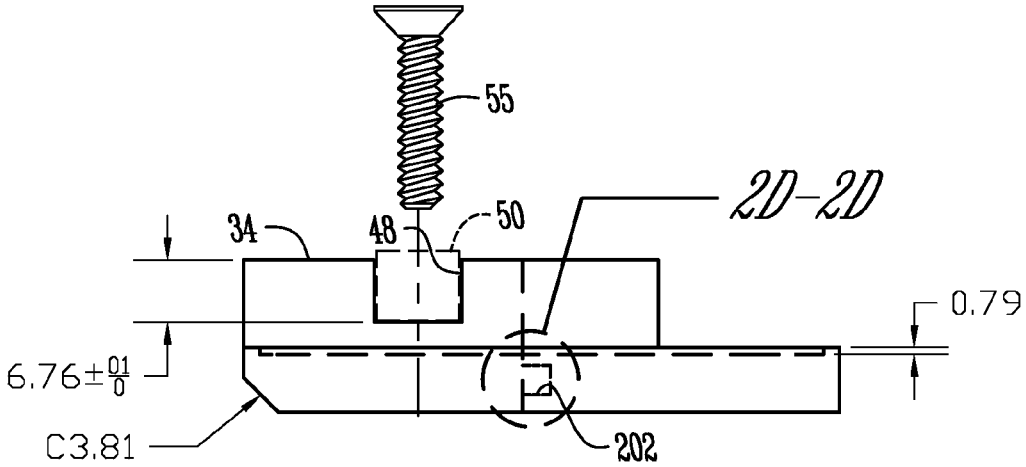
FIG. 2C is an end elevation of FIG. 2A.
Figure 2D:
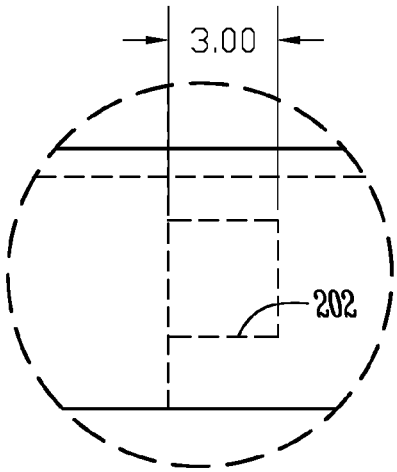
FIG. 2D is an enlargement taken at circle A of FIG. 2C.

Referring now to FIG. 2A, two tapped corresponding number 8-32 bores (ref. no. 57) are formed in the bottom of slots 48 and 49. They threadably receive the threaded ends of screws 55.

Like U.S. Pat. No. 5,867,869, the dimensions of the opposite ends of roller 50 are such that they freely insert into slots 48 and 49. Each screw 55 is then just inserted through its bore 53 and into tapped bore 57 to secure roller 50 in place. This is, of course, after roller 50 has been inserted into opening 92 in tram body 78 (see FIGS. 4B and 4C), such that opposite ends of roller 50 are extending outside of tram body 78.

Tram body 7A would also be attached to base plate 22. All that remains would be to then screw the opposite clamping body 28 to clamping body 26 as described in U.S. Pat. No. 5,867,869.

The final assembly would look as shown in FIGS. 1A-D.

The hinge would basically function similar to that shown in U.S. Pat. No. 5,867,869. In the embodiment shown in attached FIGS. 1-8, there is shown two openings 86 and 90 each for receiving a wear pad 81, 83 or 85 (FIG. 7), instead of the three shown in U.S. Pat. No. 5,867,869. Springs or other biasing members like 80, 82, or 84 of U.S. Pat. No. 5,867,869 (not shown), with bias pads 81 in the manner described in U.S. Pat. No. 5,867,869, could be used to bias the wear pads into contact with the sub-roller pin 76 when installed. Sub-roller pin 76 (FIG. 6) would function similarly to that of U.S. Pat. No. 5,867,869. It should be understood that a number of wear pads different than two could be used.

Figure 8A:
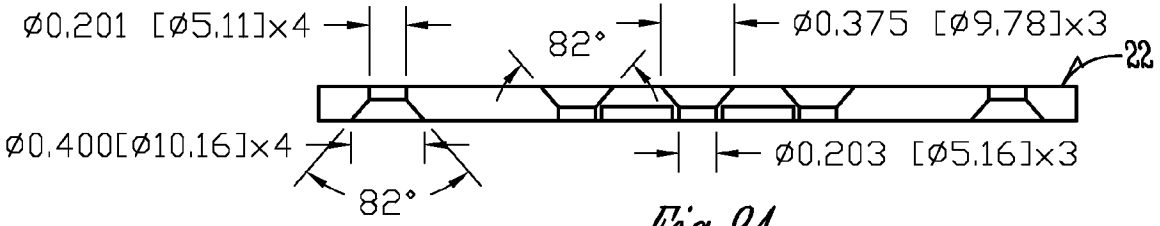
FIG. 8A is a side view of a base plate similar to base plate 22 of U.S. Pat. No. 5,867,869.
Figure 8B:
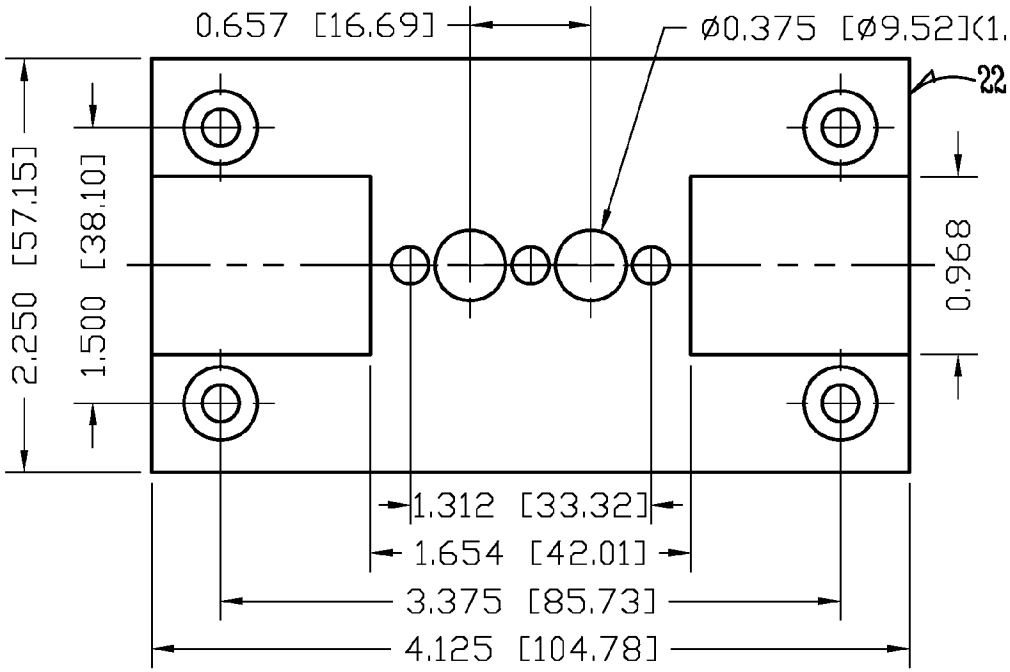
FIG. 8B is a top plan view of FIG. 8A.
Figure 8C:
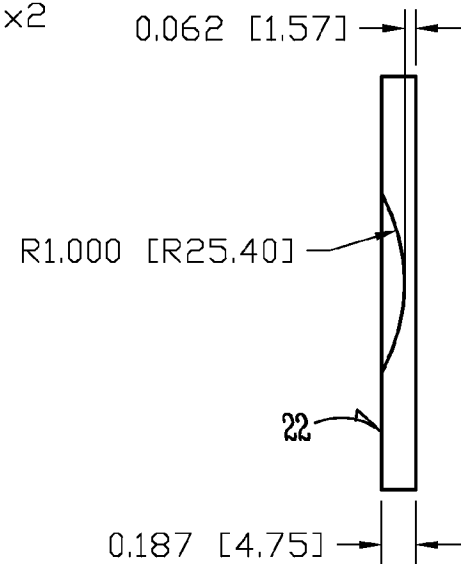
FIG. 8C is an end view of FIG. 8A.

Base plate 22 could be as shown in FIG. 8A-C. It can receive the tram body 78 and be screwed to a wall or support.

Figure 9A:
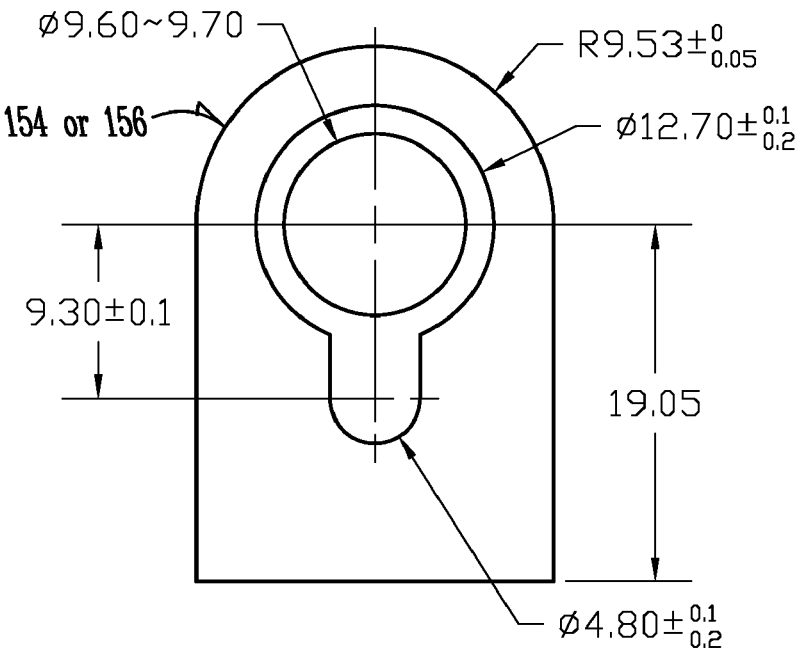
FIG. 9A is a plan view of a flexible washer similar to 154 or 156 of U.S. Pat. No. 5,867,869.
Figure 9B:
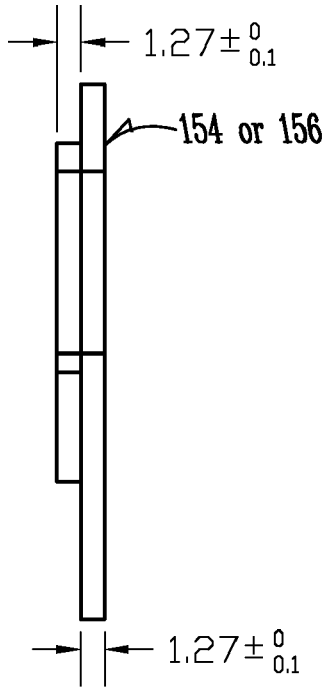
FIG. 9B is a side view of FIG. 9A.

FIG. 9A and 9B show one version of washers that could function similar to those shown at ref. nos. 154 and 156 of U.S. Pat. No. 5,867,869, but have extended portions to try to keep water away from the interior of the hinge.

It therefore can be seen that the invention is an alternative way of moveably mounting main roller 50 to clamp body 26.

As can be appreciated, the pivot pin 50 can be easily installed and removed from the hinge assembly but is robust in its securement of the pin. Substantial forces can be experienced by the ends of the pin, especially for large or heavy loads.

Options and Alternatives

The foregoing exemplary embodiment is but one form the invention can take. Variations obvious to those skilled in the art will be included in the invention which is solely defined by the claims herein.

Examples of options or alternatives are as follows.

The clamp assembly can be made of different materials. One example is brass or bronze, or other robust metals. The metals can be plated. Other materials are possible. The fastener used to fasten the pivot pin can vary. In the exemplary embodiment, a machine screw is used into a threaded bore. Alternatively, a bolt could pass through into structure in the other hinge portion and either thread into that other portion or pass through an opening in the other portion and be secured by a nut or other similar device. Still further, set screws could be used in some situations, for example, if much lighter loads are required for the hinge.

On the other hand, utilizing this installation method for the pivot pin can allow the same pivot pin and securement mechanism to be used for different hinge assemblies. This can reduce inventory and make the pivot mechanism interchangeable for a variety of different hinges that are used for a variety of different styles and functions.

Still further, bumper pads can be adhered to, embedded in and extends slightly above, or otherwise be positioned relative to portions of the hinge assembly such that when one portion is pivoted relative to the other, any abutment of surfaces would be prevented. This could prevent scratching or marring. One example is shown at reference numeral 200 in the drawings.

Furthermore, the exemplary embodiment has been shown with respect to a hinge assembly used to clamp a panel such as a glass pane or plate. It can be used for other hinging purposes. Additionally, if at least one portion of the hinge assembly is used to clamp a panel, the panel could be planar or curved or of other configurations.

What is claimed is:

1. A hinge assembly, comprising:

(a) first and second hinge portions adapted to pivot relative to one another around a pivot axis and each including a mounting surface to mount to another member;

(b) a pivot pin rotatably retained in the first hinge portion and having opposite ends;

(c) each opposite end of the pivot pin having a cross-section and an aperture through the entire cross-section;

(d) a pair of receivers in the second hinge portion matingly complementary to the cross-section of the end of the pivot pin aligned along the pivot axis into which the opposite ends of the pivot pin removably fit through insertion openings in a lateral insertion direction relative the pivot axis, each receiver having one or more surfaces which prevent movement of a corresponding opposite end of the pivot pin in directions both laterally and rotationally relative the pivot axis except for the lateral insertion direction through the insertion opening;

(e) a threaded fastener adapted to pass through the aperture of and releasably fasten each opposite end of the pivot pin to a mating threaded bore in one of the said surfaces of a corresponding said receiver of said second hinge portion in the lateral insertion direction to prevent movement of each opposite end of the pivot pin relative to the insertion direction;

(f) so that the pivot pin is removably fastenable to the second hinge portion in the lateral insertion direction but the opposite ends of the pivot pin and the surfaces of the receivers substantially take up and deter forces which would tend to move the pivot pin laterally or rotationally relative to the pivot axis.

2. The hinge assembly of claim 1 wherein the first hinge portion comprises a tram body in which the pivot pin is rotatably journaled and the mounting surface comprises a mounting plate adapted to mount to the another member, the second hinge portion comprising complimentary structure to which said fastener can be fastened and a clamp adapted to clamp opposite sides of a panel.

3. The hinge assembly of claim 2 wherein the complimentary structure comprises a threaded bore.

4. The hinge assembly of claim 3 wherein the fastener comprises a threaded fastener.

5. The hinge assembly of claim 4 wherein the threaded fastener comprises a machine screw.

6. The hinge assembly of claim 2 wherein the receiver comprises a slot adapted for mating insertion of a said opposite end of the pivot pin.

7. The hinge assembly of claim 2 wherein the clamp further comprises a gasket pocket.

8. The hinge assembly of claim 7 wherein the gasket pocket is adapted to receive a gasket having a portion retained by the gasket pocket and a portion extending above the plane of the clamp.

9. The hinge assembly of claim 8 further comprising adhesive to adhere the gasket in the gasket pocket.

10. The hinge assembly of claim 2 wherein the panel can be planar or nonplanar.

11. The hinge assembly of claim 1 wherein the aperture is through the opposite end.

12. The hinge assembly of claim 11 wherein one side of the aperture is surrounded by a countersink.

13. The hinge assembly of claim 1 further comprising at least one bumper pad on one of the first and second hinge portions of the hinge assembly adapted to prevent abutment of surfaces of first and second hinge portions.

14. The hinge assembly of claim 1 wherein the ends are flattened and the openings are through the thinnest cross-sectional dimension of the flattened ends.

15. A hinge for hinging a glass panel door to an adjacent supporting structure, comprising:

(a) a tram body comprising a housing;

(b) a main pivot roller rotatably journaled in the housing and including a main body portion and narrowed opposite end portions;

(c) a sub pin roller rotatably journaled in the housing along the main body portion of the main pivot roller;

(d) a biasing member positioned in the housing pushing the sub roller pin into abutment with the main body portion of the main pivot roller;

(e) the main body portion of the main pivot roller including an indexing detent along its length into which the sub pin roller fits when in alignment, the indexing detent having angled sides and a bottom, the angled sides being spaced so that the sub roller pin can be partially inserted into the indexing detent and contact each angled side at one point;

(f) a connecting member attached to the tram body and having a component allowing connection of the hinge to an adjacent supporting structure;

(g) the opposite end portions of the main pivot roller each including an opening through its cross-section;

(h) a clamp comprising first and second clamp halves which are adjustable toward one another to clamp opposite sides of a glass panel door and receivers comprising surfaces to prevent movement or rotation of the main pivot roller pin relative the clamp except as to an insertion direction and threaded apertures to each receive a threaded fastener through each opening in the main pivot roller to removably secure the main pivot roller to the clamp and prevent movement of the main pivot roller pin relative the clamp in the insertion direction.

16. The hinge of claim 15 wherein the threaded fastener is a machine screw.

17. The hinge of claim 15 wherein the clamp further comprises slots into which the end portions of the main pivot roller are matingly insertable.

18. A hinge assembly comprising:

(a) a pivot pin having opposite ends and rotatably mounted in a first hinge portion, the first hinge portion including mounting structure for mounting the first hinge portion to another member;

(b) a second hinge portion having a receiver for each end of the pivot pin, the second hinge portion including mounting structure for mounting the second hinge portion to another member;

(c) means for deterring lateral and rotational movement of the pivot pin relative to its pivot axis and the second hinge portion except in an insertion direction;

(d) means for securing ends of the pivot pin in the receivers by a threaded fastener through each end of the pivot pin into a threaded bore in the second hinge portion to deter lateral movement of the pivot pin in the insertion direction.

* * * * *